United States Patent [19]

Milliman et al.

[11] Patent Number: 4,980,966

[45] Date of Patent: Jan. 1, 1991

[54] ROD HOLDER FOR THE ASSEMBLY OF HEAT EXCHANGERS

[75] Inventors: James G. Milliman, Fawn River, St. Joseph County; Lawrence A. Franks, both of Sturgis, Mich.

[73] Assignee: Burr Oak Tool & Gauge Company, Sturgis, Mich.

[21] Appl. No.: 516,112

[22] Filed: Apr. 27, 1990

[51] Int. Cl.[5] ..... B23P 15/26

[52] U.S. Cl. ..... 29/727; 29/523; 29/890.044

[58] Field of Search ..... 29/726, 727, 523, 890.044; 403/348, 358, 536; 72/479; 269/43

[56] References Cited

U.S. PATENT DOCUMENTS

| | | | |
|---|---|---|---|
| 2,336,541 | 12/1943 | Gunter et al. | 269/287 |
| 4,597,171 | 7/1986 | Kitayama et al. | 29/727 |
| 4,771,536 | 9/1988 | Vanderlaan et al. | 29/727 |
| 4,780,955 | 11/1988 | Stroup | 269/43 |
| 4,835,828 | 6/1989 | York et al. | 29/727 |
| 4,839,950 | 6/1989 | Stroup | 29/727 |
| 4,930,338 | 6/1990 | Tokura | 72/479 |

*Primary Examiner*—P. W. Echols
*Assistant Examiner*—Irene Cuda
*Attorney, Agent, or Firm*—Flynn, Thiel, Boutell & Tanis

[57] ABSTRACT

A structure is provided for mounting the expander rods of a mechanical tube expander. The mounting structure comprises a slide plate which can be moved between a first position in which the expander rods are in locked condition and a second position in which the expander rods are in unlocked condition.

4 Claims, 3 Drawing Sheets

ROD HOLDER FOR THE ASSEMBLY OF HEAT EXCHANGERS

This invention relates to an improvement in structure for mounting the expander rods of a mechanical tube expander, which expander is used for fixing fins on the tubes of tube and fin-type heat exchangers.

DESCRIPTION OF THE PRIOR ART

FIG. 6 illustrates a conventional structure for mounting the expander rods 1 of a mechanical tube expander of the type indicated above. The mounting structure comprises a pressure plate 2 and a rod-holder plate 3. The rod-holder plate 3 contains a releasable lock in the form of a spring-urged ball 4 which is receivable in a recess 5 in the expander rod 1. The geometry of the ball 4 and recess 5 is such that the ball 4 cannot be moved out of the recess 5 simply by pulling downwardly on the expander rod. The expander rod 1 cannot move upwardly from the position shown in FIG. 6 because of the pressure plate 2. In order to move the ball 4 out of the recess 5, a pin 6 is pushed upwardly through the opening 7 from the underside of the rod-holder plate 3 to engage the ball 4 and move it upwardly into the passage 8 in the rod-holder plate as shown in the right-hand portion of FIG. 6. Then the expander rod 1 is removed from the rod-holder plate 3 by pulling it downwardly. Although this mounting structure for expander rods is effective for its intended purpose, it is relatively time-consuming to release a large number of expander rods 1 from an expander because of the need to insert a pin into the opening 7 associated with each of the rods. Also, because a vertical mechanical tube expander commonly has a height of more than about 10 feet and the expander rods are mounted toward the upper end thereof, a worker must stand on a raised platform or ladder, and lean in toward the machine in order to remove the expander rods. This can be difficult and may present safety problems.

U.S. Pat. No. 4 771 536 discloses an expander rod mounting structure in which a key projects into each opening in the rod-holder header. The expander rod is specially shaped so that it can be inserted into the rod-holder header and then rotated about its lengthwise axis to a position in which the key releasably locks the expander rod in place. Specially shaped expander rods are needed in this structure.

SUMMARY OF THE INVENTION

The invention provides an improvement in a mechanical tube expander for expanding tubes into interlocked relationship with fins to form tube and fin-type heat exchangers. The mechanical tube expander comprises a frame, means for holding an assembly of fins loosely stacked on tubes and a pressure plate carrying a plurality of expander rods which are aligned with the tubes. The expander rods have tube-expanding means at one end thereof and detent-receiving means close to the opposite end thereof. The detent-receiving means cooperates with means for releasably locking the expander rods to the pressure plate. Further, means are provided for reciprocating the expander rods with respect to the assembly of tubes and fins in order that the tube-expanding means will expand the tubes into interlocked relationship with the fins that are stacked thereon. The means for releasably locking the expander rods to the pressure plate comprises a rod-holder plate having through openings for holding the expander rods and detent means receivable in the detent-receiving means on the expander rods for releasably securing the expander rods to the rod-holder plate. A movable slide plate is disposed beyond the detent-receiving means of the expander rods. The slide plate has through openings corresponding in number and arrangement to the number and arrangement of the expander rods. Means are provided for moving the slide plate between a first position in which the detent means is received in the detent-receiving means and said through openings in said movable slide plate are out of alignment with the expander rods so that the expander rods are locked to the rod-holder plate, and a second position in which said detent means is displaced outside said detent-receiving means and said through openings in the movable slide plate are in alignment with the expander rods so that the expander rods can move into the openings in the slide plate and be released from locked relationship to the rod-holder plate.

The improved structure of the invention for mounting the expander rods does not require modification of the physical structure of the expander rods and the releasable lock structure that has previously been used with good results in this field. The improved structure according to the invention permits an existing mechanical expander to be retrofitted easily in order to employ the improved mounting structure thereon. The improved structure makes it possible to remove the expander rods more easily than was possible heretofore because each of the expander rods can be moved upwardly and thereby displace the ball from the recess in the expander rod. Then the expander rod can be rotated about its lengthwise axis and thereby move the recess out of vertical alignment with the ball so that the ball cannot re-enter the recess. Then the expander rod can be pulled downwardly to remove it from the rod-holder plate. The expander rods can be removed from below without requiring the workman to climb up the machine. The expander bullets can be screwed into and tightened in the lower ends of the expander rods without turning the expander rods. Further, when the tube has a spiral groove formed on its inner surface, it will not rotate and release the rod.

DETAILED DESCRIPTION

Figure 7:
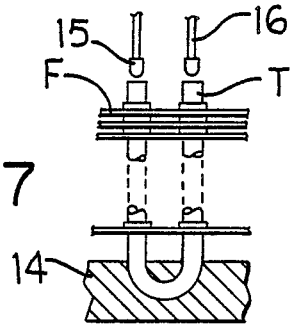
FIG. 7 is a fragmentary, schematic illustration of the tube and fin assembly and expander rods, prior to expanding the tubes.

Referring to FIG. 7, there is illustrated an assembly of hair-pin tubes T and fins F suitable for being made into a tube and fin-type heat exchanger. The fins F fit loosely on the tubes T. In use of the mechanical tube expander, the expander rods 16, which carry expander bullets 15, are moved through the tubes T so that the tubes are expanded into a tight interlocked relationship with the fins F to provide an integral, permanent assembly thereof and to provide good heat conduction therebetween.

In the following description, reference will be made to expander rods 16. It is to be understood that this term includes both one-piece rods and rods made of a plurality of sections which are releasably joined together in end-to-end relationship.

Figure 1:
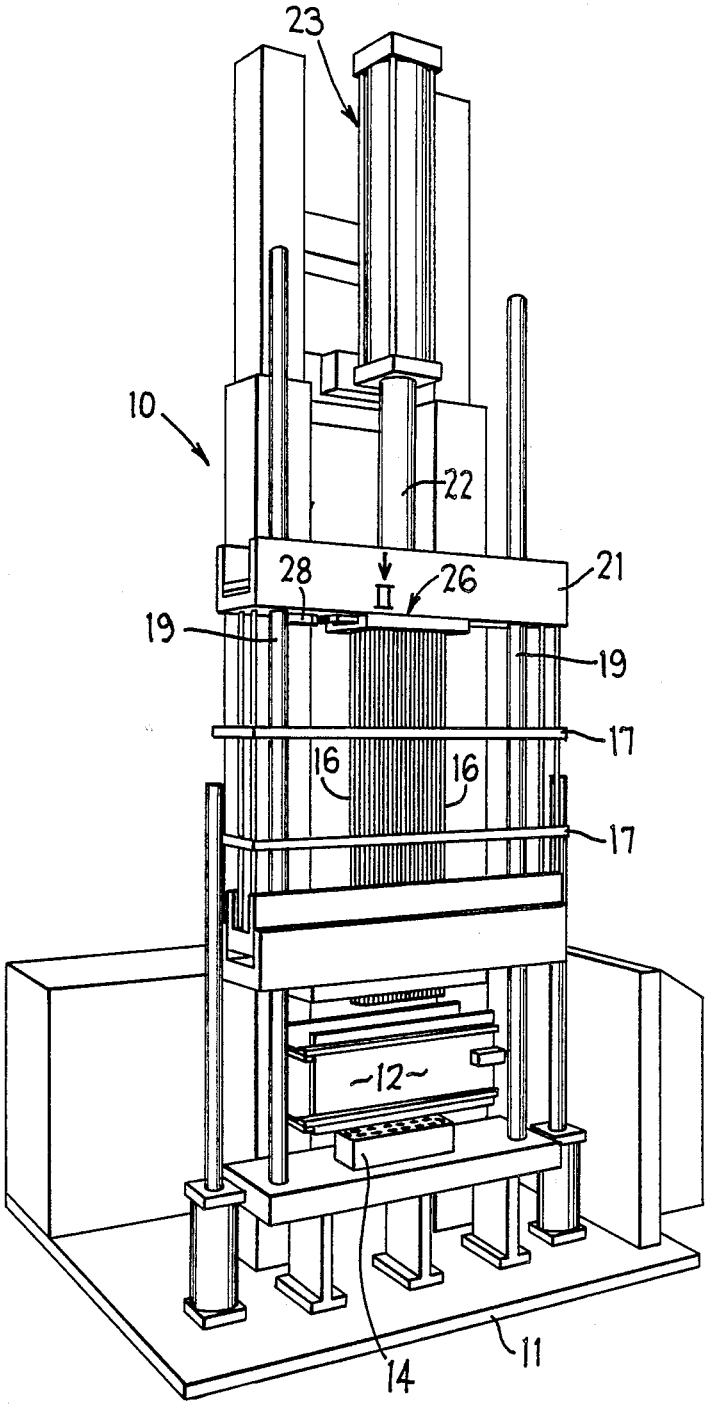
FIG. 1 is a schematic, perspective view of a vertical tube expander incorporating the improved expander rod mounting structure of this invention.

Referring to FIG. 1, a representative, vertical, tube-expander, on which the present invention can be employed, comprises a frame 10 mounted on a base 11. The tubes T and fins F to be interlocked (not shown in FIG. 1, but illustrated in FIG. 7), are disposed in a container or fixture 12. The tubes are oriented vertically and the fins are loosely stacked thereon. The block 14 supports the reversely curved (hairpin bent) lower ends of the tubes.

A plurality of expander rods 16, corresponding in number and arrangement to the number of tubes, is provided for expanding the tubes. At their lower ends, the expander rods carry expander bullets 15 (FIG. 7) which are effective to expand the tubes into interlocked engagement with the fins when the expander rods are moved vertically downwardly through the tubes. Expander rods 16 extend through guide plates 17 so that the lower ends of the rods are vertically aligned with the tubes. Vertical guide rods 19 are provided for guiding reciprocating movement of the reciprocable parts of the tube expander.

A pressure plate 21 is provided for supporting the expander rods 16 for vertical reciprocating movement. The pressure plate 21 is vertically slidably guided by the rods 19. The pressure plate 21 is connected to the piston rod 22 of the piston and cylinder assembly 23 so that the pressure plate can be moved upwardly and downwardly.

As thus far described, the mechanical tube expander 10 is of conventional structure. The details of its structure and operation are well known and, accordingly, it is believed unnecessary to describe the mechanical tube expander in greater detail. It will be understood that the invention can be employed with a wide variety of different mechanical tube expanders, including ones for expanding hairpin bent tubes and ones for expanding straight tubes, and that the invention is not limited to the specific press illustrated in FIG. 1.

According to the invention, there is provided an improved apparatus 26 for releasably locking the expander rods 16 to the pressure plate 21 so that the expander rods move vertically with the pressure plate and can be released therefrom when necessary for replacement or repair.

Figure 2:
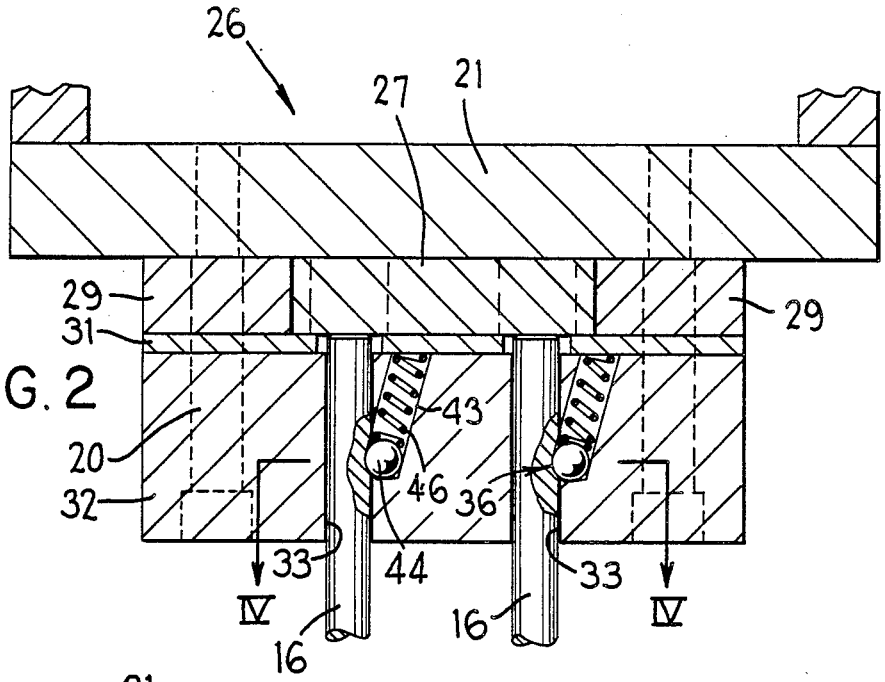
FIG. 2 is a transverse cross-sectional view through the expander rod mounting structure, the view being taken substantially at the location indicated by arrow II in FIG. 1, with the slide plate being in a position in which the expander rods are locked in the rod-holder plate.

The expander rod locking apparatus 26 is here illustrated as being affixed to the lower side of the pressure plate 21, as shown in FIGS. 1 and 2, by means of machine screws 20 (FIG. 2).

The expander rod locking apparatus 26 comprises a slide plate 27 which is adapted to be reciprocated, relative to the pressure plate 21 and rods 16, in a direction lengthwise of the pressure plate and perpendicular to the lengthwise extent of the rods 16. For this purpose, the slide plate 27 slidably contacts the lower surface of the pressure plate 21 and is reciprocated by suitable means, such as a piston and cylinder actuator 28 (FIG. 1). The slide plate 27 is guided for reciprocating movement by a pair of spacer rails 29 which are disposed on opposite lateral sides of the slide plate 27 and slidably engage and guide the side edges of the slide plate 27.

A spring-retainer plate 31 is positioned below the slide plate 27 and the spacer rails 29. The purpose of the spring-retainer plate 31 will be described hereinbelow.

A rod-holder plate 32 is positioned below the spring-retainer plate 31. The rod-holder plate 32 has a plurality of vertical through holes 33 which are arranged in the same pattern and with the same spacing as the expander rods 16. The upper end portions of the expander rods 16 extend vertically upwardly into and through the holes 33 in the rod-holder plate 32, respectively. The expander rods 16 are adapted to be manually rotated about their lengthwise axes and slid vertically in the holes 33, as will be described hereinbelow.

Figure 3:
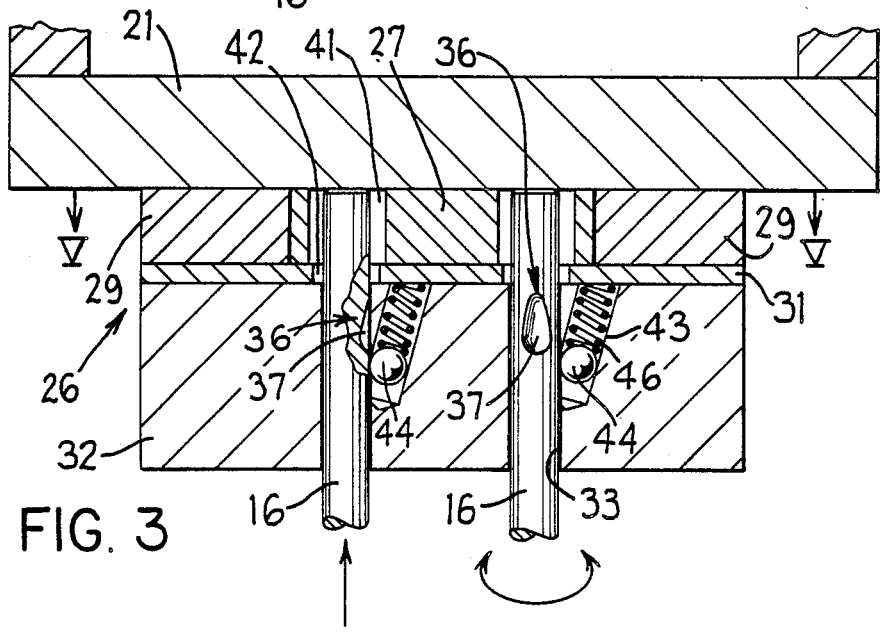
FIG. 3 is a view like FIG. 2, but showing the slide plate and expander rods in a position in which the expander rods can be removed from the rod mounting structure.

The expander rods 16 each have a concave recess 36 formed in the sidewall thereof close to the upper end thereof. In plan view, as illustrated in FIG. 3 with respect to the righthand rod 16, the recess 36 has a substantially ovate-conical or tear drop shape, with the lengthwise axis thereof being vertical, the narrow conical end being at the upper end thereof and the more rounded, wider end being at the lower end thereof. The lower end portion of the recess 36 is of substantially partially spherical shape for receiving a portion of a ball therein. The recess 36 is of progressively narrower width and progressively shallower depth in a direction toward the upper end of the recess, thereby defining a ramp 37 for leading the ball into the recess 36 when the expander rod 16 is raised relative to the ball, as will be described further hereinbelow.

Figure 5:
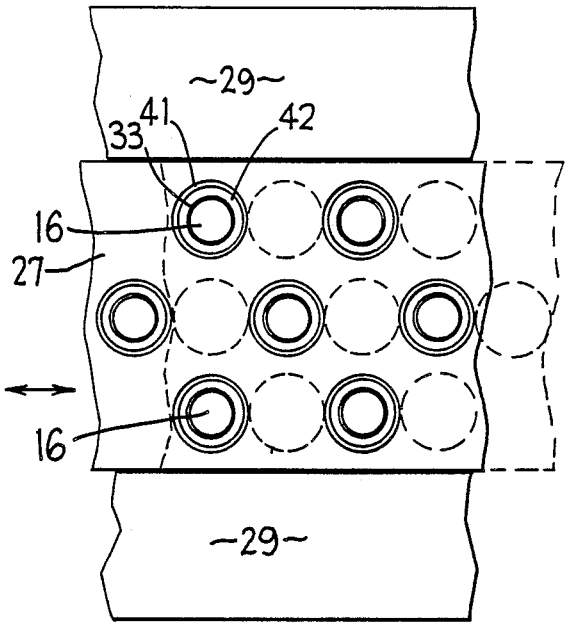
FIG. 5 is a plan view taken along the line V—V in FIG. 3.
Figure 4:
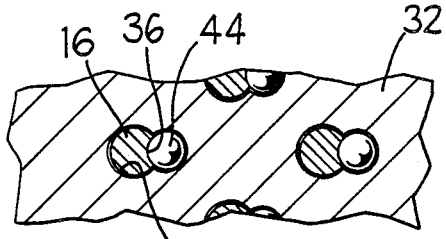
FIG. 4 is a sectional view taken along the line IV—IV in FIG. 2.
Figure 6:
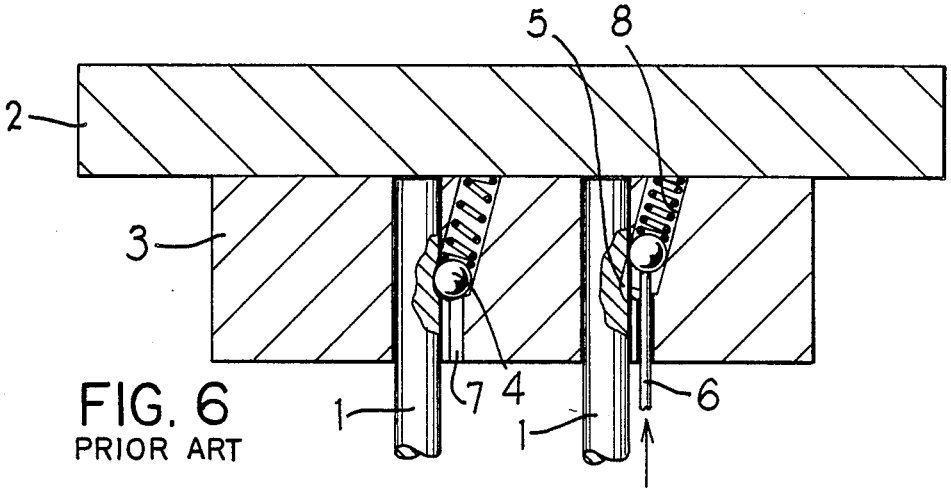
FIG. 6 PRIOR ART
FIG. 6 is a view like FIG. 2 and illustrating a prior art structure.

The reciprocable slide plate 27 has a series of through holes 41 arranged in a number, pattern and spacing corresponding to those of the expander rods 16. The stationary spring retainer plate 31 also has a series of through holes 42 arranged in a number, pattern and spacing corresponding to those of the expander rods 16 and holes 41. The holes 42 are of larger diameter than the holes 33, and the holes 41 are of larger diameter than the holes 42. The upper ends of the expander rod 16 extend into the through holes 42. In one terminal position of the slide plate 27 (FIG. 2 and the broken-line position in FIG. 5), the through holes 41 in the slide plate 27 are out of vertical alignment with the through holes 42 in the spring-retainer plate 31. In this position, the upper ends of the expander rods 16 abut against the lower surface of the slide plate 27. In the other terminal position of the slide plate 27 (FIG. 3 and the solid line position shown in FIG. 5), the respective through holes 41 and 42 are vertically aligned and the expander rods 16 can manually be moved upwardly into the through holes 41 in the slide plate 27 to the position shown in FIG. 3.

The rod-holder plate 32 has an inclined, blind-ended hole 43 associated with each of the through holes 33. The holes 43 open through the upper surface of the rod-holder plate 32 and the upper ends of the holes 43 are closed by the spring-retainer plate 31. The bottom portion of the side wall of the inclined hole 43 intersects and opens through the sidewall of the adjacent associated expander rod-receiving hole 33. A ball 44 is disposed in each hole 43 and is resiliently urged downwardly therein by a compression coil spring 46 which is received in the hole 43. The upper end of the spring 46 engages the lower surface of the spring retainer plate 31. Each of the balls 44 is urged toward the bottom of its associated hole 43 and against the sidewall of its associated expander rod 16. When the recess 36 in the expander rod 16 is vertically and horizontally aligned with the ball 44, the ball extends into the recess as shown in FIG. 2. In the FIG. 2 position of the parts, the expander rods 16 are releasably locked in position.

When it is desired to unlock the expander rods 16 for removing them from the apparatus, the slide plate 27 is moved to the position shown in FIG. 3, wherein the through holes 33, 41 and 42 are in vertical alignment. Then, as shown by the lefthand expander rod 16 in FIG. 3, that expander rod is pushed upwardly so that the recess 36 raises the ball 44 and simultaneously cams it out of the recess 36. Continued upward movement of the expander rod 16 causes the upper end of the expander rod 16 to abut against the lower surface of the pressure plate 21. In this position, the recess 36 is located completely above the ball 44 and is substantially isolated from the hole 43.

Then, as shown by the righthand expander rod in FIG. 3, the expander rod 16 is rotated about its lengthwise axis through a suitable angle, such as from about 90° to 270°, so that the recess 36 is moved out of vertical alignment with its associated ball 44. Then the expander rod 16 can be freely slid downwardly for removing it from the rod-locking apparatus. During the removal of the expander rod 16 it is necessary to slightly rotate the rod while pulling the rod downward. The slight rotation of the rod 16 alleviates the frictional force of the ball 44 against the side of the expander rod, as the spring 46 is still forcing the ball against the side of the expander rod. The replacing of rods is not a reversing of steps as the slide plate 27 must be closed before rods are inserted. The same or a different expander rod 16 can be installed and locked in place by moving the slide plate 27 to its closed position, as illustrated in FIG. 2, followed by substantially the reverse sequence of steps of manipulating the expanding rods.

Although a particular preferred embodiment of the invention has been described, the invention contemplates such changes or modifications therein as lie within the scope of the appended claims.

The embodiments of the invention in which an exclusive property or privilege is claimed are defined as follows:

1. In a mechanical tube expander for expanding tubes into interlocked relationship with fins, comprising a frame, means for holding on said frame an assembly of fins loosely stacked on tubes, a pressure plate carrying a plurality of expander rods which are aligned with the tubes, said expander rods having tube-expanding means at one end thereof and detent-receiving means close to the opposite end thereof, means for releasably locking said expander rods to said pressure plate and means for reciprocating said expander rods with respect to said assembly in order to expand the tubes into interlocked relationship with the fins that are stacked thereon, the improvement comprising; said means for releasably locking said expander rods comprises a rod-holder plate having through openings for holding the expander rods and detent means receivable in said detent-receiving means on said expander rods for releasably securing said expander rods to said rod-holder plate, a movable, slide plate disposed beyond said detent-receiving means on said expander rods, said slide plate having through openings corresponding in number, spacing and arrangement to the number, spacing and arrangement of said expander rods, and means for moving said slide plate between a first position in which said detent means is received in said detent-receiving means and said through openings in said movable slide plate are out of alignment with said expander rods so that said expander rods are locked to said rod-holder plate and a second position in which said detent means is displaced outside said detent-receiving means and said through openings in said movable slide plate are in alignment with said expander rods so that said expander rods are released from locked relationship to said rod-holder plate.

2. A mechanical tube expander as claimed in claim 1, in which said detent means is a spring-urged ball which is urged toward its associated expander rod and said detent-receiving means in said expander rod is a recess having a partially spherical portion for receiving the ball and a ramp extending from said partially spherical portion for camming said ball into said recess when said expander rod is moved with respect to said ball.

3. A mechanical tube expander as claimed in claim 2 in which said ball is received within an inclined hole in said rod-holder plate, wherein the inner end of said inclined hole intersects the through opening for its associated expander rod in said rod-holder plate and the outer end of said hole extends through the surface of said rod-holder plate, a coil spring disposed in said inclined hole, and a spring retainer plate for retaining said springs in said inclined holes.

4. A mechanical tube expander as claimed in claim 3, in which said slide plate is guided for reciprocating movement between said first and second positions, and including a piston and cylinder actuator connected to said slide plate and adapted for moving said slide plate between said first and second positions.

* * * * *